United States Patent [19]

Senter

[11] 4,068,395

[45] Jan. 17, 1978

[54] SHOE CONSTRUCTION WITH UPPER OF LEATHER OR LIKE MATERIAL ANCHORED TO INNER SOLE AND SOLE STRUCTURE SEALED WITH FOXING STRIP OR SIMULATED FOXING STRIP

[76] Inventor: Jonas Senter, 910 Fifth Ave., New York, N.Y. 10011

[21] Appl. No.: 722,055

[22] Filed: Sept. 9, 1976

Related U.S. Application Data

[63] Continuation of Ser. No. 555,612, March 5, 1972, abandoned.

[51] Int. Cl.[2] ..... A43B 00/00; A43C 13/08

[52] U.S. Cl. ..... 36/83; 36/14

[58] Field of Search ..... 36/14, 83; 12/142 RS, 12/145, 142 T

[56] References Cited

U.S. PATENT DOCUMENTS

| | | | |
|---|---|---|---|
| 2,481,389 | 9/1949 | Campagna | 36/14 |
| 3,416,174 | 12/1968 | Novitske | 36/14 |
| 4,003,145 | 1/1977 | Liebscher et al. | 12/145 |

FOREIGN PATENT DOCUMENTS

| | | | |
|---|---|---|---|
| 462,178 | 5/1926 | Germany | 12/142 T |

*Primary Examiner*—Patrick D. Lawson
*Attorney, Agent, or Firm*—Haseltine, Lake & Waters

[57] ABSTRACT

A shoe construction which includes an upper formed of leather or like material not easily bonded to rubber, an inner sole and an outer sole in which shoe the upper is indirectly anchored into the inner sole and an outer rubber or rubber-like enclosing member seals any exposed joints in the sole structure. An intermediate strip formed of a textile material is secured to the lower portion of the leather or like upper and is lasted into the inner sole, such textile strip thus being compatible with the outer enclosing member in the sense that they can be firmly bonded by means of vulcanization or other adhesion effecting techniques.

4 Claims, 3 Drawing Figures

FIG. 1
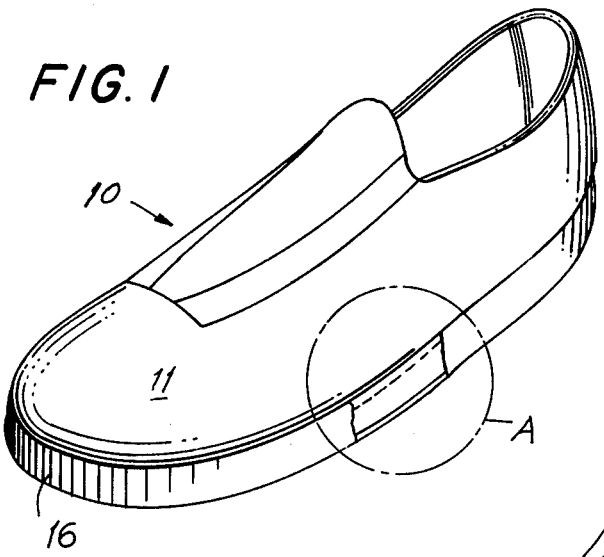
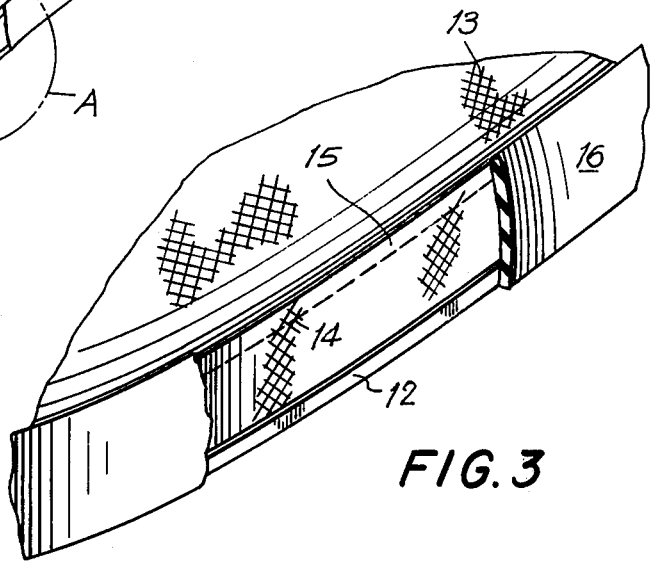
FIG. 3
FIG. 2
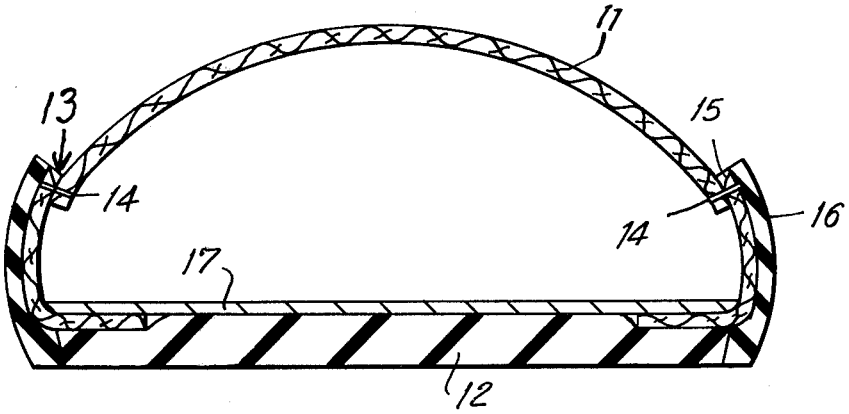

SHOE CONSTRUCTION WITH UPPER OF LEATHER OR LIKE MATERIAL ANCHORED TO INNER SOLE AND SOLE STRUCTURE SEALED WITH FOXING STRIP OR SIMULATED FOXING STRIP

This is a continuation, of application Ser. No. 555,612 filed Mar. 5, 1975, now abandoned.

BACKGROUND OF THE INVENTION

This invention relates to the construction of a shoe, and more particularly to such shoes, preferably of the sporty type, in which the uppers are made of leather, suede, or of a generally smooth-surfaced plastics material such as polyurethane, PVC (polyvinyl chloride) which is not readily bonded to rubber, and an outer member encloses the joints of the lasted sole structure to afford protection against scuffing and resistance to the penetration of moisture.

It has been known heretofore to construct shoes with leather uppers or with uppers made of various plastics materials such as PVC and polyurethane and with an outer sole made of rubber or a rubber-like material. However, certain difficulties manifest themselves subsequent to the lasting of such uppers when an outer enclosing rubber or rubber-like member is to be adhesively secured to the shoe. In order to obtain the requisite adhesion between the outer member, which may be a foxing strip or a simulated foxing strip, and the upper, extensive treatment of the uppers in a preliminary processing step was required. Such processing customarily took the form of either roughening the area of the upper to be adhered to by the outer member, chemically treating such area or otherwise modifying the surface characteristics of the upper to provide the desired bonding between the materials. Frequently, especially when roughening of the upper was performed, the upper was reduced in thickness or otherwise altered which resulted in an area of weakness at the very location where the shoe is subjected to bending and flexure stresses when in use. This has often led to a reduction in the useful life of the shoe and has necessitated periodic shoe repair and maintenance. Further, in order to vulcanize leather shoes with such prior constructions it has been necessary to pre-treat the leather, such as by tanning, in order to enhance the adhesive characteristics of the leather by removal of or neutralization of certain fats and/or oils which adversely affected adhesion.

Where the outer enclosing member is applied to the shoe in an automatic operation, such as by injection molding, the rubber or rubbery material of the outer member migrates over the adjacent surface of the leather, necessitating a laborious and time-consuming leather cleaning sequence.

Still further, in shoe constructions where the upper is lasted into the inner sole by one of the conventional lasting techniques, the amount of leather or like material required to effectuate lasting added to the cost of the shoe and resulted in the unnecessary consumption of a valuable material.

Culter in U.S. Pat. No. 1,622,860 issued Mar. 29, 1927 taught the securing of leather uppers to the crepe outer sole of a shoe by means of an intermediate strip made of fabric and saturated with rubber latex.

U.S. Pat. No. 2,024,167 to Kent, Jr. issued Dec. 17, 1935 discloses the use of an intermediate strip, of leather or a thin strong material, into which rubber has been ground or impregnated, and an edge barrier strip. However, the leather upper was lasted into the sole structure by being made of sufficient length to be turned under the inner sole.

Wherever employed in the claims or description of this invention the expression "leather or like material" is intended to include those materials which cannot be readily bonded to rubber without the use of a preparatory chemical treatment to remove or neutralize fats and/or oils present in the material or a mechanical surface-roughening treatment to enhance the adhesive characteristics of the material.

SUMMARY OF THE INVENTION

It is, therefore, one object of the invention to provide a shoe construction by means of which the upper of leather or a material not easily bonded to rubber can be indirectly lasted into the inner sole of the shoe with a minimum use of such material.

It is another object of the invention to provide a shoe construction in which the upper can be made of leather or like material and an outer foxing strip or simulated foxing strip can be applied in an automatic processing step to protectively seal the sole structure of the shoe without the need to subsequently clean the upper of material which has migrated during such application step to mar the appearance of the shoe.

Other objects and advantages of the invention will become readily apparent from the following description of the invention.

In accordance with this invention there is provided in an article of footwear having an inner sole, an outer sole, an upper of leather or like material and an outer element or member enclosing the sole structure, the improvement comprising an intermediate strip of material stitched to the lower peripheral edge of the upper, adjacent one of the edges of the strip and lasted into the inner sole at its other edge, said intermediate strip presenting a substantially vertical surface for bonding with the outer element, and the latter extending upwardly to overlie and be adhesively secured to the vertical surface of the intermediate strip.

BRIEF DESCRIPTION OF THE DRAWINGS

In order that the invention may be more fully comprehended it will be described, by way of example, with reference to the accompanying drawing in which:

FIG. 1 is a perspective view of an article of footwear embodying the invention with a segment of the sidewall broken away;

FIG. 2 is a front view of the toe of the shoe in cross-section; and

FIG. 3 is an enlarged view of insert A of FIG. 1.

DETAILED DESCRIPTION OF THE INVENTION

Referring to the drawing there is shown an article of footwear 10 having an upper 11 and a rubber outer sole 12. The upper may be made of leather or a leather-like plastics material such as PVC or polyurethane. In its preferred form the invention contemplates the use of leather. Secured to the lower margin 13 of the upper, preferably adjacent its bottom marginal edge, by means of one or more rows of stitches 14, is an intermediate strip 15. The strip or tape of material extends the full periphery of the upper in generally parallel relation to its lower edge. Strip 15 is fabricated from a material which is compatible with, i.e., is capable of close bonding or adherence to a foxing tape or simulated foxing tape 16. It will be understood that although the invention is described with relation to a structure in which a separate foxing strip is employed it is equally applicable where the "foxing strip" is the upper vertically extending region of the outer sole. The strip 15 is preferably fabricated from a textile material which is subsequently treated in a known manner to provide such compatability. It will be appreciated that the aforementioned foxing strips are generally made of rubber or of a rubber-like material.

The upper 11 of the shoe is shown as being indirectly lasted beneath an inner sole 17 by the intermediary of the strip 15 according to the invention, and the latter may be stitched to the sole such as in the "California construction", or otherwise joined to the inner sole in a conventional manner. It is within the scope of the invention, for example, to string last the upper.

Although not shown, it will be understood that a bottom filler may be interposed between the inner sole 17 and the outer sole 12 in order to provide for added cushioning if so desired.

As shown clearly in FIG. 2, the intermediate strip 15 extends downwardly from the point of its attachment to the leather upper 11 and is lasted into the inner sole. In effect the strip 15 becomes an extension of the upper in that it serves to anchor the leather upper, yet it does so without the need to continue the leather material into the inner sole structure. According to the preferred embodiment of the invention, therefore, the leather portion of the 11 terminates at a point above the inner sole 17. This enables manufacture of the shoe with a minimum quantity of leather and thereby reduces the material cost of the shoe.

Superposed over intermediate strip 15 throughout its peripheral extent is an outer enclosing member. This member may take the form of a separate foxing or barrier strip 16. As stated above, the foxing strip may be fabricated of rubber or of a rubber-like material so as to enable adhesion of the foxing strip to the outer edge of the rubber or rubber-like outer or bottom sole 12.

The strip 16 is secured to the upper 11 of the shoe by being bonded to the intermediate strip 15 which underlies same when the foxing strip is properly positioned on the shoe. Bonding can be achieved as desired either by means of a suitable adhesive or through a conventional heat setting vulcanization step. Once so bonded to the outer sole and the intermediate strip the joint between the upper and the sole structure of the shoe is sealed against the penetration of moisture and is guarded against scruffing and side blows imparted to the shoe. It will be recognized, however, that the invention contemplates the application of the outer element to the shoe as an integral portion of the outer sole. For example, the outer sole 12 and the element 16 can be applied by means of conventional injection molding apparatus or by resort to a mold in which the material selected to form the outer sole of the shoe is heated to a temperature which effects a flow of such material and the molding of a unitary outer sole and outer enclosing member. In both of these instances the mold can, if so desired, be provided with surface ornamentation in order to impart to the element 16 the appearance of a simulated foxing strip.

In the manufacture of the shoe described, the intermediate tape or strip 15 can be sewn to the leather portion of the upper 11 while same is in a flat condition before the sole structure 12, 17 is applied to the shoe.

It will, of course, be appreciated that the leather portion of the upper may be natural leather or a simulated leathery composition such as one of the aforementioned plastics materials.

From the foregoing it will be seen that a shoe construction has been provided which permits one to obtain the benefits of a lasted construction with a minimum expenditure of the relatively expensive uppers material and which provides for the ready incorporation of an outer protective element which can either be a separate foxing strip or an integral portion of the outer sole.

I claim:

1. An article of footwear (10) having a sole structure that comprises an outer sole (12) of rubber material, an inner sole (17) placed inside the footwear upon said outer sole, an upper (11) of leather or like material that is difficult to be bonded to rubber, such as the outer sole, and an outer member (16) disposed about said outer and said inner soles, on the one hand, and said upper on the other; a separate intermediate strip (15) positioned between said outer member and said upper, said intermediate strip (15) being substantially coextensive with said outer member to form a contact surface boundry therewith, said strip being of a textile material readily bondable both to the leather material of said upper and to the rubber material of said outer sole and affixed to a lower peripheral edge (13) of said upper, adjacent the upper edge of said strip, and lasted with its bottom edge into said inner sole; said intermediate strip in cooperation with said outer member forming a common connection between said outer and said inner soles and said upper, whereby said strip provides a substantially vertical contact surface for bonding with said outer member and extending upwardly to overlie and be secured to a part of said upper.

2. The article of footwear as defined in claim 1, wherein said outer member (16) is a separate foxing tape applied to said sole structure coextensive with said lower peripheral edge (13) of the upper (11) and being affixed to said intermediate strip (15).

3. The article of footwear as defined in claim 1, wherein said outer member (16) being defined as an integral extending portion of said outer sole (12) having a vertical portion adhered to said intermediate strip (15).

4. The article of footwear as defined in claim 1, wherein said outer member (16) terminates at the upper region thereof along a line which coincides with said upper edge of the intermediate strip (15), said line being disposed above the lowermost portion of said upper.

* * * * *